United States Patent [19]

Ward

[11] Patent Number: 4,904,379

[45] Date of Patent: Feb. 27, 1990

[54] SKIMMER-DIVERTER ASSEMBLY FOR REMOVING DEBRIS FROM SWIMMING POOLS AND THE LIKE

[76] Inventor: John F. Ward, 402 Bunker Hill Dr., Pensacola, Fla. 32506

[21] Appl. No.: 267,449

[22] Filed: Nov. 4, 1988

Related U.S. Application Data

[63] Continuation-in-part of Ser. No. 86,508, Aug. 18, 1987, Pat. No. 4,789,470.

[51] Int. Cl.[4] ..... E04H 3/20

[52] U.S. Cl. ..... 210/169; 210/242.1; 4/490; 4/512; 134/167 R

[58] Field of Search ..... 210/169, 416.2, 242.1, 210/242.3; 4/490, 492, 510, 512; 134/167 R

[56] References Cited

U.S. PATENT DOCUMENTS

| | | | |
|---|---|---|---|
| 3,244,284 | 4/1966 | Shaffer | 210/242.1 |
| 3,764,015 | 10/1973 | Rolfson | 210/242.1 |
| 3,774,767 | 11/1973 | Field | 210/169 |
| 4,030,148 | 6/1977 | Rosenberg | 134/167 R |
| 4,221,662 | 9/1980 | Joseph | 210/169 |
| 4,264,444 | 4/1981 | Bronnec | 210/242.3 |
| 4,379,749 | 4/1983 | Roth | 210/169 |
| 4,455,695 | 6/1984 | Mikhel | 4/490 |
| 4,707,253 | 11/1987 | Rowe | 210/169 |
| 4,734,189 | 3/1988 | Page | 210/169 |
| 4,746,424 | 5/1988 | Drew | 210/242.1 |
| 4,781,827 | 11/1988 | Shields | 210/169 |
| 4,789,470 | 12/1988 | Ward | 210/169 |

*Primary Examiner*—W. Gary Jones
*Assistant Examiner*—Coreen Y. Lee
*Attorney, Agent, or Firm*—Birch, Stewart, Kolasch & Birch

[57] ABSTRACT

A skimmer-diverter assembly for use with swimming pools having water filtration and circulation systems. The skimmer-diverter assembly includes an elongated arm positioned adjacent the skimmer intake of the spool filtration and circulation system. A flow augmenting apparatus is used with the elongated arm to direct an augmented current flow along the arm to enhance the entrainment of debris and direct the debris toward the side wall of the pool and skimmer intake.

47 Claims, 6 Drawing Sheets

SKIMMER-DIVERTER ASSEMBLY FOR REMOVING DEBRIS FROM SWIMMING POOLS AND THE LIKE

FIELD OF THE INVENTION

The present application is a continuation-in-part application of my co-pending application, Ser. No. 086,508, filed on Aug. 18, 1987 now patented 4,789,470.

This invention relates to skimmer devices for removing floating and slightly submerged debris from swimming pools and more particularly, to a skimmer-diverter assembly which cooperates with the water circulating and filtration system of a swimming pool to divert debris into the pool skimmer intake port with enhanced efficiency.

BACKGROUND OF THE INVENTION

Keeping a swimming pool free of debris is a primary nuisance associated with pool ownership. Many swimming pools include automatic or built-in circulating and filtration systems which cause the pool water to circulate either continuously or over extended intervals. These systems are provided with a skimmer intake such that floating debris passing near the skimmer intake of such systems is sucked into that intake and collected in a trap. The trap is then periodically cleaned in a conventional manner.

In conventional systems, floating debris caught in the circulating current of the system readily bypasses the skimmer intake unless it is close enough to be sucked into that intake. The skimmer intake is usually defined in the pool wall and extends from above the surface to a short distance below the surface to enable it to ingest floating debris.

Diverter devices which extend outward from the pool wall adjacent to skimmer intakes for the purpose of enhancing the collection of floating debris are known in the prior art. By way of example, debris diverter arms cooperating with skimmer intakes in swimming pools having circulation and filtration systems are shown in U.S. Pat. No. 3,152,076 to Kreutzer, issued Oct. 6, 1964; 3,244,284 to Shaffer, issued Apr. 5, 1966; 3,774,767 to Field, issued Nov. 7, 1973; 4,068,327 to Heinlein, issued Jan. 17, 1978; 4,221,662 to Joseph, issued Sept. 9, 1980; 4,225,436 to Cseh, issued Sept. 30, 1980; 4,379,749 to Roth, issued Apr. 12, 1983; and 4,455,695 to Mikhel. This litany of patents illustrates the ongoing and long felt need in the art for a skimmer-diverter assembly of enhanced efficiency and simplicity of utilization. The simplicity of utilization also involved the problem of having to remove such diverter arm assemblies from the pool. Coworsely, if such diverter arm assemblies remain in the pool then there is a concern that this will impair a swimmer's use of the pool.

SUMMARY OF THE INVENTION

Accordingly, it is a primary object of the present invention to provide a new and novel skimmer-diverter arm assembly of enhanced efficiency.

It is a further object of the present invention to provide a new and novel skimmer-diverter arm assembly which is self retracting to a position against the pool wall when not in use.

It is a further object of the present invention to provide a new and novel diverter arm assembly of increased efficiency by enhancing and directing current flow along both the upstream and downstream side of the diverter arm assembly.

It is a further object of the present invention to provide a new and novel diverter arm assembly of increased efficiency by augmenting current flow along the arm portion to accelerate entrained debris toward the pool's side wall and skimmer intake.

Briefly, the present invention provides a skimmer-diverter assembly for swimming pools and the like in which a water circulation and filtration system is present having a skimmer intake at a side wall of the pool in which the circulation system has established a flow direction of water circulation. An elongated floating arm portion is provided having one end adapted to be positioned adjacent the downstream side of the skimmer intake and having an opposite end. A mounting means for the assembly such as a pivot structure or hinge is provided at the said one end of the arm portion and the skimmer intake to permit the other end of the arm portion to assume positions away from and adjacent to the side wall of the pool. An operative position of the assembly is assumed when the arm portion is at an acute angle to the flow direction of the circulating water in the pool. A retracted position of the assembly is assumed when the other end of the arm portion is adjacent the side wall of the pool downstream from the skimmer intake.

A first flow directing means is provided on the floating arm portion and extends from a position above the water surface to a position below the water surface to constrain circulating water to flow both upward and inward along the upstream side of the arm portion into the skimmer intake, entraining floating debris and causing it to be carried toward and ingested by the said skimmer intake.

A second flow directing means is provided on the other end of said arm portion to enhance the flow inward along the upstream side of the arm portion provided by the first flow directing means and also contain the circulating water in the pool to flow along the downstream side of the arm portion to entrain floating debris and force it toward the side wall of the pool. A restraining means is provided to maintain the assembly in the operative position. The second flow directing means is so formed with a flow gate in its leading edge and internal surfaces, as to react with the flow of water in the pool, upon release of the restraining means, to force the whole assembly to pivot about the mounting means and assume the retracted position.

A flow augmenting means is provided for directing an augmented current flow along the arm portion to enhance the entrainment of debris thereby and accelerate said entrained debris toward the pool's side wall and the skimmer intake.

Further objects, advantages, and features of the invention will be apparent in the arrangement and construction of the constituent parts in detail as set forth in the following specification taken together with the accompanying drawings.

DETAILED DESCRIPTION OF THE DRAWINGS

Figure 1:
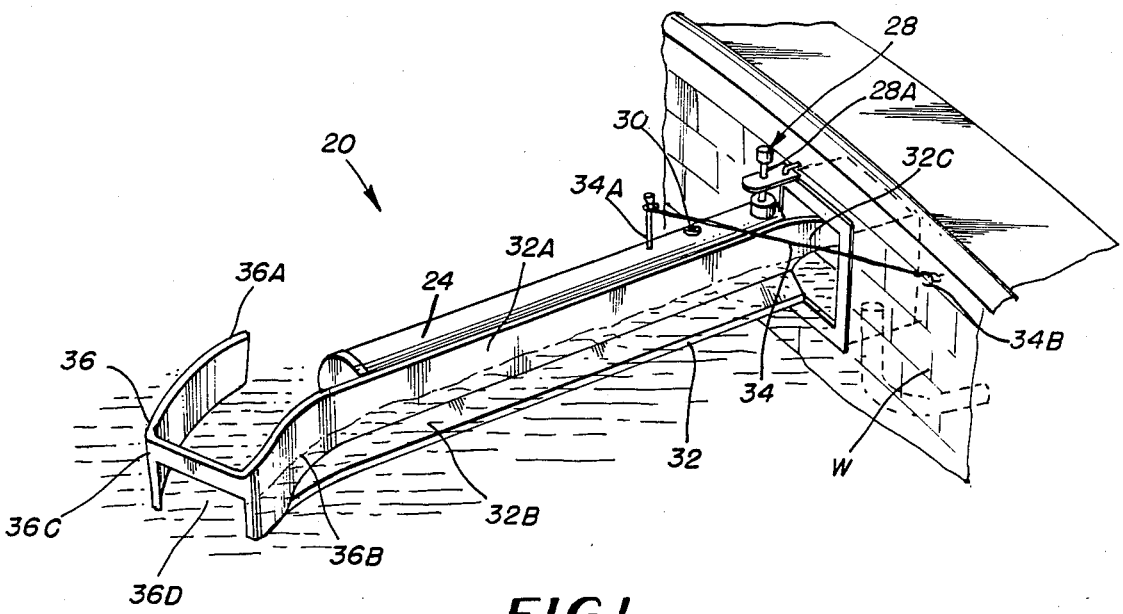
FIG. 1 is a perspective of a skimmer-diverter assembly of the present invention.
Figure 2:
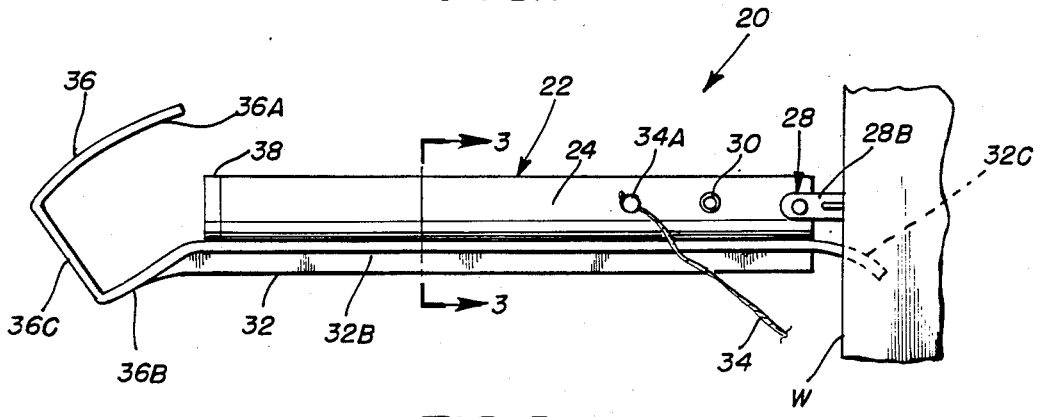
FIG. 2 is a top plan view of a preferred embodiment of the present invention.

Referring in detail to the drawings and with particular reference to FIGS. 1 and 2, the skimmer-diverter assembly 20 of the present invention is shown as including a floating arm portion 22 comprised of a floating ballast boom 24 extending substantially the entire length of the floating arm portion 22 and having one end 26 pivotally connected to the wall W of a swimming pool or the like by means of a hinge assembly 28. As will be hereinafter more fully described, the hinge assembly 28 permits two degrees of freedom, one of flotation in a vertical direction and a pivotal movement in a horizontal plane, e.g., a plane parallel to the surface of the water in the swimming pool in which the skimmer-diverter assembly 20 is positioned. Both the hinge assembly 28 and the pool wall W are shown schematically in FIG. 2 with the pool wall W being shown schematically in Figure 1.

The floating ballast boom 24 is provided with drilled holes or the like in the lowermost portion thereof and an air bleed valve 30 in the upper surface thereof to permit air to be bled from the floating ballast boom 24 to thereby predetermine the depth of flotation of the entire assembly 20 with respect to the surface of the water in a swimming pool.

Figure 3:
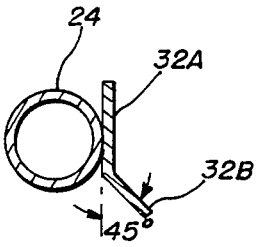
FIG. 3 is a cross-section taken along line 3—3 of FIG. 2 illustrating the angular relationships of the above-and below surface portions of the elongated deflection surfaces of the skimmer-diverter arm in the present invention.

Substantially coextensive with the length of the ballast boom 24 is a first flow directing diverter fin 32 having a vertical disposed and horizontally extending upper portion 32A and an angled substantially coextensive lower portion 32B. The lower portion 32B, as shown in FIG. 3, is angled in a preferred configuration at 45 degrees to the vertical and extends away from the ballast arm 24. As will be hereinafter more fully described this is for the purpose of intercepting the skimmer current caused by the circulation system in the pool to cause flow diversion upward along the entire length of the first diverter fin 32 on the floating air portion 22. Also, as will hereinafter be more fully described, the vertically disposed, horizontally extending upper portion 32A of the first diverter fin 32 directs flow inward from the outermost tip of the floating arm portion 22 towards the wall W of the swimming pool when the skimmer-diverter assembly 20 is in what will be defined as its operating position.

A further innermost curved portion 32C is provided as an extension of the upper diverting surface portion 32A of the first diverting fin 32 for the purpose of extending a flow diverting surface into the pool skimmer trap.

In order to place the entire skimmer-diverter assembly 20 into operative position there is provided a flexible cable or link 34 which extends from a fixed post 34A on the upper surface of the ballast boom 24 to a fixed position 34B on the pool wall W, such that by varying the length of the flexible line 34 a particular angle of the floating arm portion 22 with respect to the pool wall W can be achieved to define an operating position for the skimmer-diverter assembly 20.

The skimmer-diverter assembly 20 is completed by a second diverter means comprising a concave/convex compound second diverter fin 36 having vertically disposed surface portions extending horizontally outward and backward around the outer end 38 of the floating arm portion 22 and ballast boom 24 such that the free end 36A of the compound second diverter fin 36 is pointing in a direction substantially parallel to the rear or downstream side of the floating ballast boom 24 and the first diverter fin assembly 32. Immediately adjacent the outer end 38 of the floating ballast boom 24, and adjoining the outer end 38 of the first diverter fin assembly 32, the compound second diverter fin 36 presents a concave surface 36B at the upstream side of the skimmer-diverter assembly 20. Thereafter, the compound second diverter fin 36 presents a convex surface 36C from the transition point with the concave surface 36B all the way to the free end 36A thereof. As best shown in FIG. 1, a flow gate 36D is provided in the major portion of the upstream segment of the convex surface 36C, to permit access therethrough of current flow in the pool for the purpose of diverting flow along the inner surface of the convex surface 36C, past the free end 36A, and parallel 1 to the downstream side of the skimmer-diverter assembly 20 in its operative position and to provide a reaction surface to that current, such that when the flexible link 34 is released from the pool wall W, the entire skimmer-diverter assembly 20 will be forced by that current into a position adjacent the pool wall W and downstream from the trap chamber therein.

Figure 7:
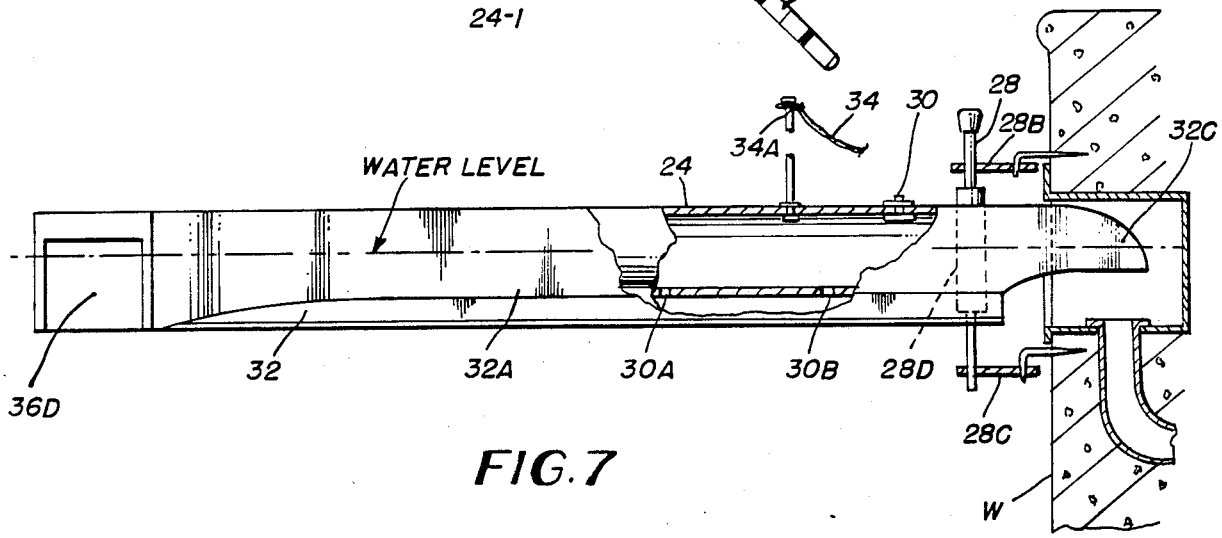
FIG. 7 is a partial front elevation in enlarged scale illustrating the mounting means for securing the assembly of the present invention to the wall of a swimming pool.
Figure 8:
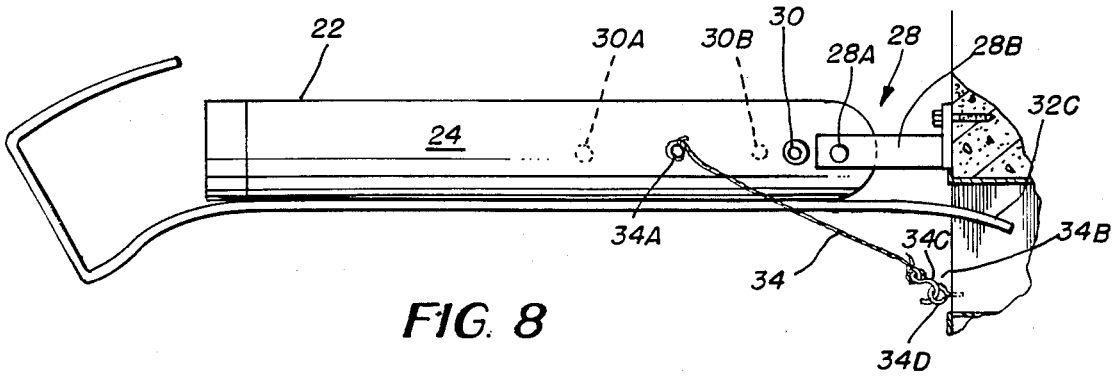
FIG. 8 is a top plan view of the elevation of FIG. 7.

Referring next to FIGS. 7 and 8, the details of the hinge assembly 28 and flexible link 34 together with enlarged partial details of the first flow diverter 32 are clearly shown. The hinge assembly or mounting assembly 28 is shown as including a spindle or hinge pin 28A which is received at its upper and lowermost extremities in brackets 28B and 28C, respectively, with the intermediate portion of the pin 28A including an enlarged sleeve or cylindrical T-section 28D integrally formed with the inboard end of the floating ballast boom 24. The enlarged central sleeve portion 28D does not extend the full distance between the brackets 28B and 28C so as to permit vertical movement of the hinge pin 28A in the said brackets due to flotation of the ballast boom 24 and the variation in the position of the water level in the pool with respect to the trap chamber as shown in FIG. 7.

As further can be seen from FIGS. 7 and 8, the flexible link 34 is fixed at one end to the floating ballast boom 24 by means of a vertically extending fixed post 34A and carries a hook or other suitable connecting means 34C at its opposite end which cooperates with a screw eye or the like 34D on the pool wall W adjacent the trap chamber as best shown in FIG. 8.

As also illustrated in FIGS. 7 and 8, there is an air valve 30 positioned in the top surface of the floating ballast arm 24 which may be in the form of a petcock, which cooperates with one or more holes such as 30A and 30B drilled in the submerged lowermost portion of the floating ballast boom 24 to permit the ingestion of water into the boom as air is permitted to escape through the valve 30 to thereby adjust the buoyancy and flotation level of the entire assembly 22.

Figure 4:
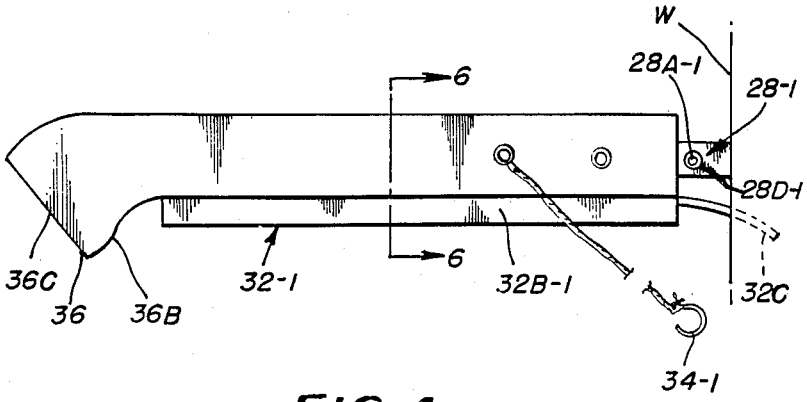
FIG. 4 is a top plan view of another preferred embodiment of the present invention.
Figure 5:
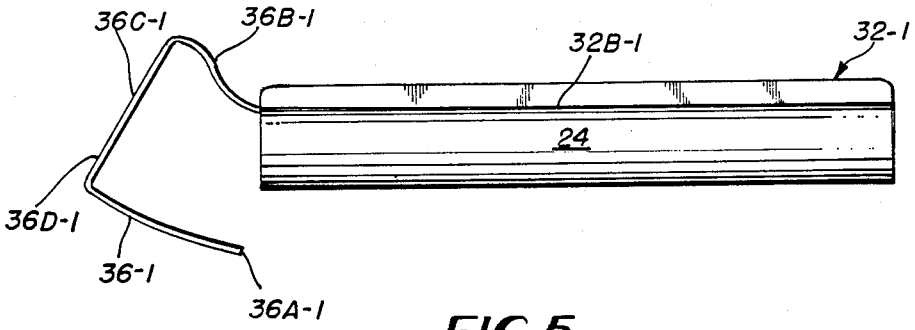
FIG. 5 is a bottom plan view of the embodiment of FIG. 4.
Figure 6:
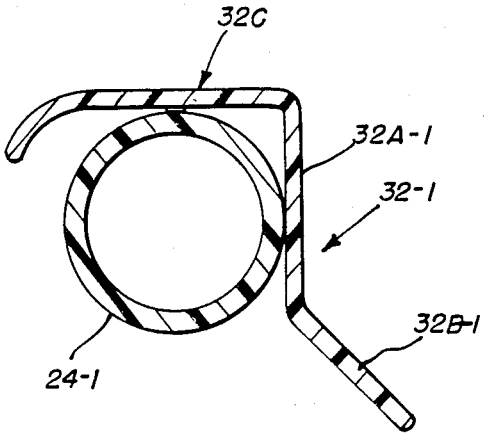
FIG. 6 is a cross-section taken along line 6—6 of FIG. 4.

A first alternate embodiment of the present invention is partially illustrated in FIGS. 4, 5 and 6 in which the entire diverter structure is molded from a single piece of plastic or the like such that there are no sharp or protruding edges providing a structure which can be both inobtrusive and remain in the pool without impairing the use thereof. Like portions of the embodiments of FIGS. 4, 5 and 6 to those of the embodiments of FIGS. 1–3, 7 and 8 carry like numerals With the suffix-1. The primary difference in the two embodiments is that there is a complete unitary top shield 32C which covers both the compound curved second diverter fin 36-1 and the floating ballast boom 24-1.

Another preferred embodiment of the skimmer-diverter assembly 20 is shown in FIGS. 11–16. This alternative preferred embodiment further increases the efficiency of the pool-skimmer assembly by incorporating a flow augmenting apparatus to direct an augmented flow along the upstream and downstream sides of the floating arm portion 22.

Figure 11:
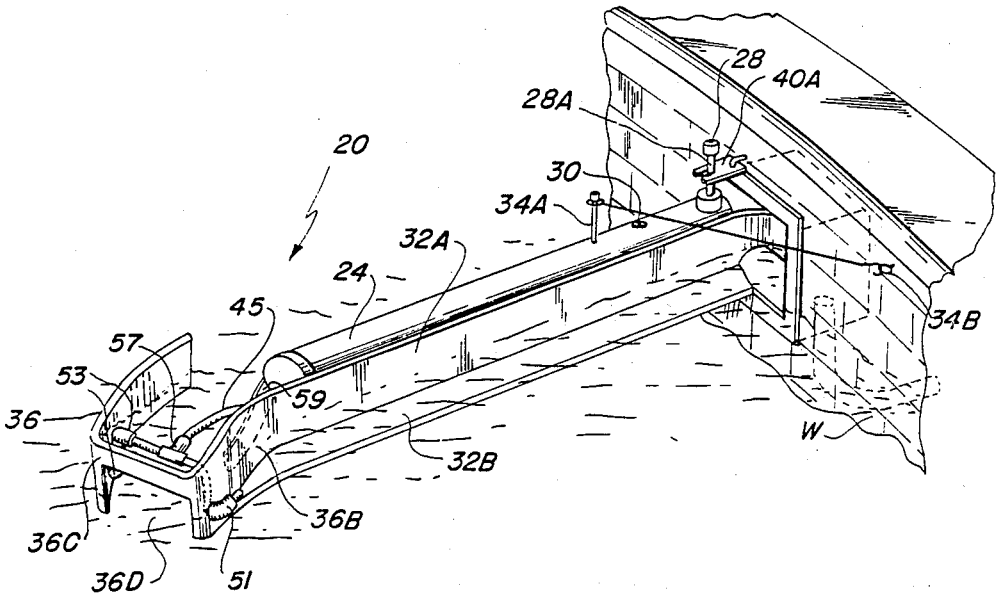
FIG. 11 is a first perspective of another preferred embodiment of the present invention.
Figure 12:
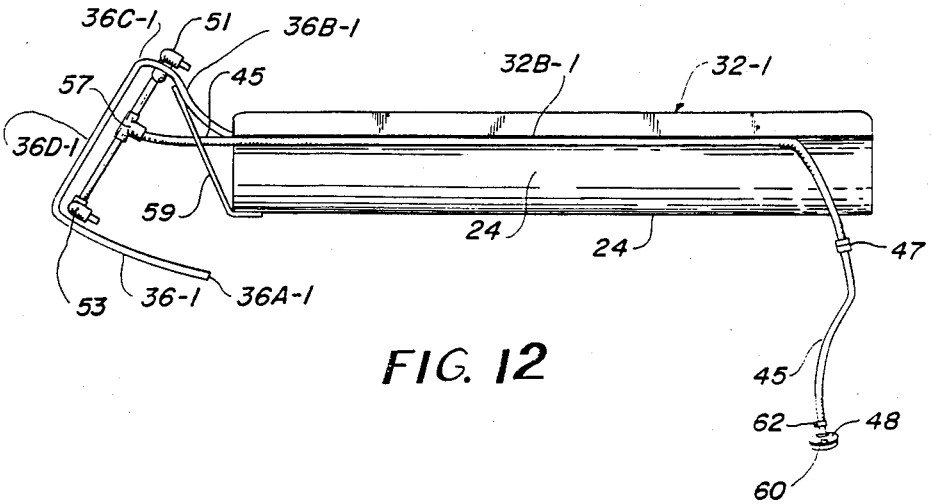
Figure 12 is a bottom plan view of the embodiment of FIG. 11.
Figure 13:
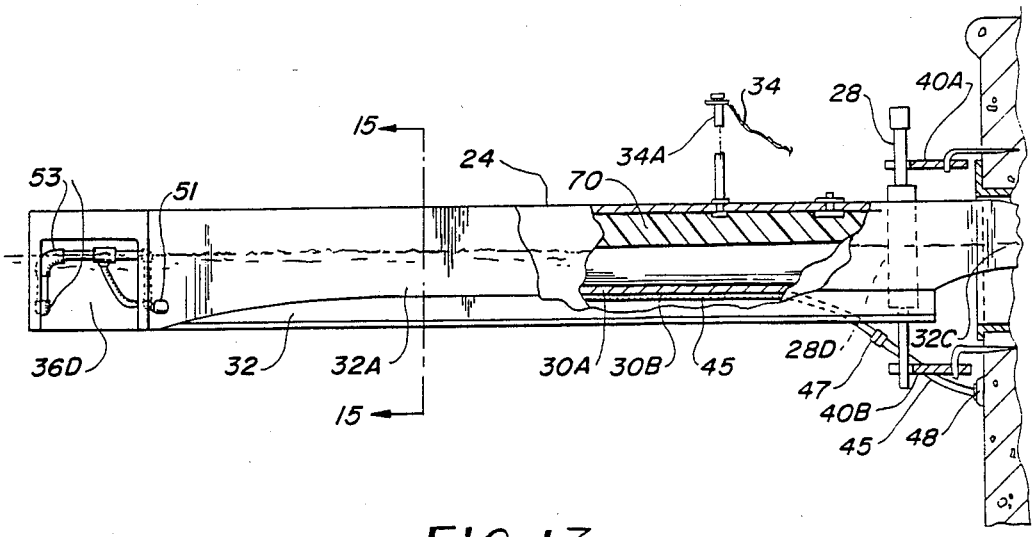
FIG. 13 is a front elevation in enlarged scale and partial cross-section of the embodiment of FIG. 11, illustrating the mounting means for securing the assembly of the present invention to the wall of a swimming pool.
Figure 14:
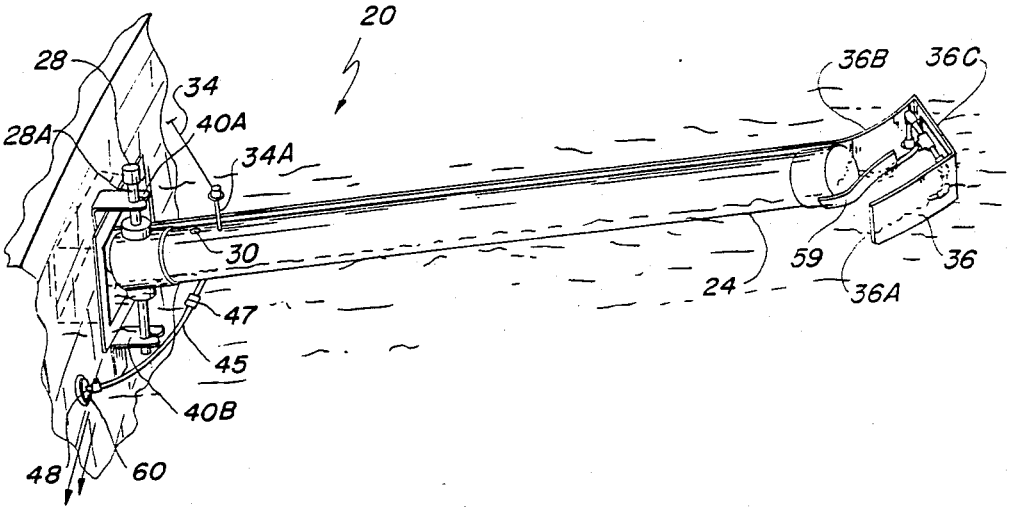
FIG. 14 is a rear perspective of the embodiment of FIG. 11.
Figure 15:
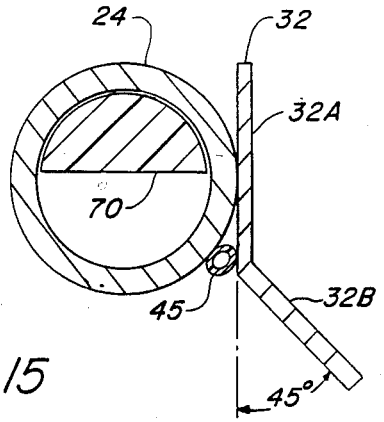
FIG. 15 is a cross-section taken along line 4—4 of FIG. 12 of an alternation preferred embodiment.
Figure 16:
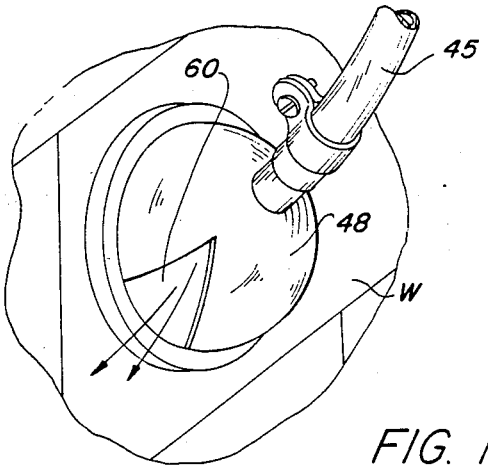
FIG. 16 is perspective of a eyeball coupling within a pool illustrating the connection between the pool circulation and filtration system with the flow enhancing apparatus of the present invention.

The flow augmenting apparatus of FIGS. 11–16 is designed to be used in combination with conventional pool filtration and circulation systems. As shown in FIG. 12 and 16, the flow augmenting apparatus is connected to the swimming pool's water return through an adjustable eyeball coupling 48. In conventional pool filtration systems, the eyeball coupling 48 serves to create a desired current flow in the pool for directing debris toward the filter intake. In this preferred embodiment of the pool skimmer-diverter assembly, the eyeball coupling 48 serves two functions. First, as in conventional systems, the eyeball coupling 48 creates a current flow in the pool through an opening 60 and returns water to the pool from the filtration system. Second, it also serves to provide water to the flow augmenting apparatus through a flexible fluid supply hose 45. A conduit is inserted into one side of the eyeball coupling 48 to tap a portion of the water returned from the filtration system. The force of the water returned through the eyeball coupling 48 is sufficient to supply water both to operate the flow enhancing apparatus and create a current flow in the pool. As illustrated in FIGS. 12 and 14, a flexible supply tube 45 is extended from the eyeball coupling 48 and positioned along the bottom side of the floating arm portion 22 and between the first flow diverting fin 32 and the floating ballast boom 24. The supply tube 45 then extends to a T-shaped joint coupling 57 for supplying water to a front hydrojet 51 and a rear hydrojet 53.

To avoid blocking any debris from entering the flow gate 36D, right angle tubing is used to connect the T-shaped joint coupling 57 to the front and rear hydrojets. The flexible supply tube 45 is composed of two separate portions 45A and 45B. The two respective portions are connected by a quick-snap coupling 47 to allow quick and easy removal of the skimmer-diverter assembly from the pool without disturbing the flow created by the adjustable eyeball coupling 48 connection.

As shown in FIG. 11, a pair of hydrojets 51 and 53 are positioned at the outer end of the floating arm assembly 38. A first hydrojet 51 is positioned on the concave surface 36B for directing a stream of water along the upstream side of the floating ballast boom 24 and substantially parallel to the first diverting fin 32. A second hydrojet 53 is positioned along the inner portion of the convex surface 36C of the second diverter fin 36 for augmenting flow along the downstream side of the floating ballast boom 24.

Both hydrojets 51 and 53 are respectfully positioned on the first and second diverter fins slightly below the upper surface of the water when the skimmer-diverter arm is placed in the pool. In this position, the hydrojets direct a stream of water underneath and parallel to the upper surface of the water to entrain debris and further enhance the efficiency of the pool skimmer-diverter assembly. A plurality of such hydrojets may be positioned on the front and/or rear of the ballast arm to further increase the augmented flow. To assure an augmented flow underneath and parallel to the surface of the water, the hydrojets 51 and 53 used in the flow enhancing apparatus are circularly adjustable in a plane perpendicular to the upper surface of the water.

Referring specifically to FIGS. 11, 12 and 14, an alternative hinge assembly 40 is shown. The alternative hinge assembly or mounting assembly 40 is shown as including a spindle or hinge pin 20 which is received at its upper and lower extremities and upper and lower snap-away hinge brackets 40A and 40B. As with the previously-disclosed embodiments, the ballast arm 24 can still retain both vertical and horizontal movement along the hinge pin 28. However, the upper and lower snap-away hinge brackets 40A and 40B freely release the skimmer-diverter assembly from the pool wall W if a swimmer should accidentally engage the assembly.

With reference to FIG. 12, an additional feature of the alternative preferred embodiment is shown. To prevent the collection of debris at the outer end of the floating arm assembly 22, a baffle 45 i affixed to the inner side of the concave surface 36B of the second diverter fin 36. The baffle 45 diverts water flowing through the flowgate 36 away from and prevents debris from accumulating in the recess between the interior side of the concave surface 36B and the outer end of the floating arm assembly 22.

As illustrated in FIGS. 13 and 15, the floating ballast boom 24 also includes a core 70 made of buoyant material, such as a foamed plastic, to assure that the floating ballast boom 24 remains afloat even if the boom fills with water. The core 70 is shown in FIG. 15 as occupying only the upper portion of the ballast boom 24, however, the core 70 may occupy a larger or smaller portion of the ballast boom 24.

OPERATION OF THE INVENTION

Figure 9:
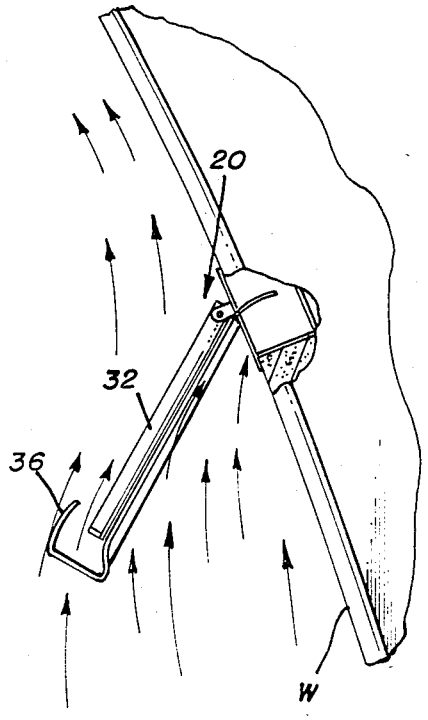
FIG. 9 is a schematic illustration of a skimmer-diverter assembly of the present invention in operative position in a pool.
Figure 10:
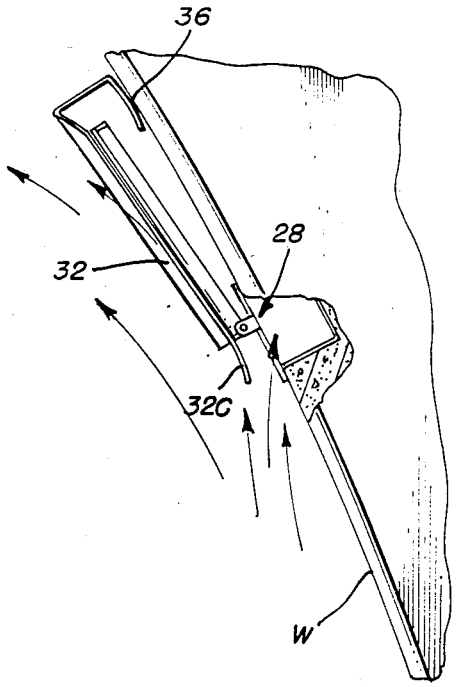
FIG. 10 is a schematic illustration of a skimmer-diverter assembly of the present invention in a retracted position in a pool.

Referring to FIGS. 1, 2, 9 and 10, the operation of the present invention will now be described. As shown in FIG. 1, a series of flow patterns results from the operative position of the skimmer-diverter assembly 20 which is illustrated in FIG. 9 and FIG. 2 as being disposed at an angle (FIG. 9) with respect to the pool all of about 55 degrees in a preferred embodiment. This acute angle with respect to the pool wall W results in a diversion of the current flow in the swimming pool as illustrated by the flow arrows in FIG. 1 and FIG. 9 as follows:

Current flow striking the outermost portion 36C of the compound second flow diverter fin 3 travels around the exterior of the compound flow diverter fin 36 in a turbulent flow as illustrated. Current flow entering the gate portion 36D of the compound flow diverter 36 impinges upon the interior of the convex surface 36C and is directed past the terminal edge 36A of the compound flow diverter fin 36 in a direction substantially parallel to the downstream side of the floating ballast boom 24. Thus, any debris entrained in the current and flowing through the gate 36D is captured by the current and directed towards the pool wall W such that on the next pass around the pool it can engage the first flow diverter 32 and be carried into the trap chamber of the pool skimmer.

Current flow which directly enpinges upon the first flow diverter fin 32 engage both the lower upwardly angled surface 32B and the vertical surface 32A thereof to cause both an upward and inward flow direction such that debris entrained in those currents is passed along the upstream side of the floating arm assembly 22 into the trap chamber of the pool skimmer.

Assuming that the pool is now clean and swimmers wish to utilize the pool, the flexible link 34 is unhooked from the screw eye 34D and released whereupon the force of the current flowing in the pool against both the first diverter fin 32 and the compound flow diverter fin 36 forces the skimmer-diverter assembly 20 about the hinge pin 28A towards the pool wall W downstream of the trap chamber of the pool skimmer. As the floating arm assembly 22 approaches the pool wall, the flow of current in the pool through the gate portion 36D of the compound second flow diverter fin 36 reverses and flows from the formerly trailing terminal edge 36A backwards through the gate 36D causing a reaction which forces the floating arm assembly 22 even closer to and maintains it proximate with the pool wall W in response to the action of the pool current.

Thus, the skimmer-diverter assembly 20 will remain in an inobtrusive and unimpairing position adjacent the pool wall so long as the pool circulation system and skimmer are energized without the need to permanently or actively tether the assembly in that position. Then, when it is desired to remove surface debris from the pool, the flexible link 34 is utilized to draw the flotation arm assembly 22 away from the pool wall W and place it back into the operative position illustrated in FIGS. 1 and 9 to thereby commence entraining floating debris in the diverted current and directing it into the trap chamber. This position is maintained by reengaging the hook 34C on the end of the flexible link 34 with the screw eye 34D at the position 34B on the pool wall W.

As another alternative construction to the hooded construction of FIGS. 4, 5 and 6, the first flow diverter 32 and compound second flow diverter fin 36, if left in an open configuration, may be manufactured from an elastomeric material which need only be of sufficient rigidity to divert current but which may be sufficiently flexible so as to give in response to an impact thereby precluding any injury to a swimmer who might accidentally engage that portion of the assembly.

In the alternative preferred embodiment disclosed in FIGS. 11–14, water supplied through the pool filtration and circulation system is used for augmenting current flow parallel to and along the downstream and upstream portions of the floating arm portion 22 by a flow augmenting apparatus. Water is supplied to the flow augmenting apparatus through an adjustable eyeball coupling 48 and flexible fluid supply hose 45 into two respective hydrojets 53 and 51 used for augmenting current flow along the upstream and downstream sides of the floating ballast arm 24.

Water through the front hydrojet 51 creates an augmented current flow along the upstream portion of the skimmer-diverter assembly enhancing the entrainment of debris along the first diverter fin 32 for ingestion into the pool intake. The rear hydrojet 53 is positioned adjacent the interior side of the convex surface 36C for creating an augmented current flow beyond the free-end 36A, parallel to the downstream portion of the floating ballast arm 24. The augmented flow along the downstream portion of the ballast arm provides enhanced entrainment and movement of debris along the rear of the floating ballast arm 24 to the pool wall W for recirculation around the periphery of the pool and ultimately encountering the upstream side of the diverter arm assembly 20 for ingestion into the pool intake. By using hydrojets along the upstream and downstream sides of the diverter arm, the enhanced flow decreases the time required for any debris to be entrained in the current and ingested into the trap chamber of the pool skimmer in the pool wall W.

The present invention having been thus described, it should be apparent that modifications could be made to the various components of the system, as would occur to one of ordinary skill in the art without departing from the spirit and scope of the present invention.

I claim:

1. A skimmer-diverter assembly for swimming pools having a water circulation and filtration system and a skimmer intake at a side wall thereof and having an established flow direction of circulation, said assembly comprising:

elongated arm means having one end thereof adapted to be positioned adjacent the downstream side of said skimmer intake and an opposite end for diverting the flow of said circulation system toward said side wall; and flow augmenting means positioned on said arm means for augmenting current flow along said elongated arm means to enhance the entrainment of debris thereby and accelerate said entrained debris toward said pool side wall.

2. The skimmer-diverter assembly as recited in claim 1, wherein said flow augmenting means creates an augmented current flow on the downstream side of said elongated arm means.

3. The skimmer-diverter assembly of claim 1, wherein said flow augmenting means creates an augmented current flow on the upstream side of said elongated arm means toward said skimmer intake.

4. The skimmer-diverter assembly as recited in claim 1, wherein said flow augmenting means creates an augmented current flow on the upstream and downstream sides of said elongated arm means toward said side wall and said skimmer intake.

5. The skimmer-diverter assembly of claim 1, wherein said elongated arm means is buoyant.

6. The skimmer-diverter assembly of claim 1, further comprising mounting means on said one end of said arm means for mounting said assembly adjacent said skimmer intake to permit said opposite end to be positioned, selectively, away from and adjacent to said side wall.

7. The skimmer-diverter assembly of claim 6, wherein said mounting means includes a hinge assembly means including snap coupling means for quick release of said arm means from said pool wall.

8. The skimmer-diverter assembly of claim 1, wherein said flow augmenting means includes hydrojet means for providing said augmented current flow.

9. The skimmer-diverter assembly of claim 5, wherein said elongated arm means includes buoyant core means for maintaining said elongated arm means in a floating condition at the surface of the water in a said pool.

10. The skimmer-diverter assembly of claim 9, wherein said buoyant core means is a foamed plastic material.

11. The skimmer-diverter assembly of claim 8, further comprising:

fluid supply means for supplying fluid to said flow augmenting means.

12. The skimmer-diverter assembly of claim 11, wherein said fluid supply means is said water circulation and filtration system.

13. The skimmer-diverter assembly of claim 11, wherein said fluid supply means further comprises conduit means for connecting said fluid supply means to said hydrojet means.

14. The skimmer-diverter assembly of claim 13, wherein said fluid supply means includes coupling means for connecting said conduit means to said fluid supply means.

15. A skimmer-diverter assembly for swimming pools having a water circulation and filtration system and a skimmer intake at a side wall thereof and having an established flow direction of circulation, said assembly comprising:

elongated arm means having one end thereof adapted to be positioned adjacent the downstream side of a said skimmer intake and an opposite end:

mounting means on said one end of for pivotally mounting said assembly adjacent a said skimmer intake to permit said opposite end to be positioned, selectively, away from and adjacent to a side wall;

first flow diverting means on said arm means extending from a position above the water surface in a said pool to a position below said water surface and constraining water circulating in said established direction of circulation to flow both upwardly and inwardly along the upstream side of said arm means and into a said skimmer intake when the opposite end of said arm means is away from said side wall and said arm means is angled acutely with respect to said wall into the said direction of circulation to effect an operative position thereof;

second flow diverting means on said other end of said arm means extending from a position above to a position below the said water surface for enhancing the flow inward along said arm means constrained by said first flow diverting means and constraining said water circulating in said pool to flow inwardly along the downstream side of said arm means when said arm is in said operative position;

flow augmenting means positioned on said arm means for augmenting said flow inward along said arm means to enhance the entrainment of debris thereby and accelerate said entrained debris toward said pool side wall and said skimmer intake; and retaining means for selectively retaining said arm portion in said operative position.

16. The skimmer-diverter assembly of claim 15, wherein said flow augmenting means creates an augmented current flow on the downstream side of said elongated arm means.

17. The skimmer-diverter assembly of claim 15, wherein said flow augmenting means creates an augmented current flow on the upstream side of said elongated arm means toward said skimmer intake.

18. The skimmer-diverter assembly of claim 15, wherein said flow augmenting means creates an augmented current flow on the upstream and downstream sides of said elongated arm means toward said side wall and said skimmer intake.

19. The skimmer-diverter assembly of claim 15, wherein said elongated arm means is buoyant.

20. The skimmer-diverter assembly of claim 15, further comprising mounting means on said one end of said arm means for mounting said assembly adjacent said skimmer intake to permit said opposite end to be positioned, selectively, away from and adjacent to said side wall.

21. The skimmer-diverter assembly of claim 20, wherein said mounting means includes a hinge assembly means including snap coupling means for quick release of said arm means from said pool wall.

22. The skimmer-diverter assembly of claim 15, wherein said flow, augmenting means includes hydrojet means for providing said augmented current flow.

23. The skimmer-diverter assembly of claim 19, wherein said elongated arm means includes buoyant core means for maintaining said elongated arm means in a floating condition at the surface of the water in said pool.

24. The skimmer-diverter assembly of claim 23 wherein said buoyant core means is foamed plastic material.

25. The skimmer-diverter assembly of claim 22, further comprising:

fluid supply means for supplying fluid to said flow augmenting means.

26. The skimmer-diverter assembly of claim 25, wherein said fluid supply means is said water circulation and filtration system.

27. The skimmer-diverter assembly of claim 26, wherein said fluid supply means further comprises conduit means for connecting said fluid supply means to said hydrojet means.

28. The skimmer-diverter assembly of claim 22, wherein said fluid supply means includes coupling means for connecting said conduit means to said fluid supply means.

29. The skimmer-diverter assembly of claim 15, wherein said second flow diverting means is further responsive to release of said arm means from said retaining means and to the flow of water circulating in a said pool to constrain said arm portion to pivot in said mounting means and assume a wall adjacent position in said pool downstream of a said skimmer intake to effect a retracted position of said assembly.

30. The skimmer-diverter assembly of claim 15, wherein said first flow diverting means comprises an elongated upright surface portion substantially coextensive with said arm means and substantially orthogonal to the surface of said water and an elongated submerged surface portion substantially coextensive with and extending beneath said upright surface portion and having the lowermost edge thereof upstream of said upright surface portion in said operative position of said assembly.

31. The skimmer-diverter assembly of claim 15, wherein said mounting means permits vertical displacement of said assembly.

32. The skimmer-diverter assembly of claim 30, wherein said second flow diverting means is further responsive to release of said arm means from said retaining means and to the flow of water circulating in a said pool to constrain said arm means to pivot in said mounting means and assume a wall adjacent position in said pool downstream of a said skimmer intake to effect a retracted position of said assembly.

33. The skimmer-diverter assembly according to claim 31, wherein said second flow diverting means is further responsive to release of said arm means from said retaining means and to the flow of water circulating in a said pool to constrain said arm means to pivot in said mounting means and assume a wall adjacent position in said pool downstream of a said skimmer intake to effect a retracted position of said assembly.

34. The skimmer-diverter assembly according to claim 15, wherein said second flow diverting means comprises a hydrofoil having a concave-convex leading edge portion substantially orthogonal to the said surface of the said water with the concave portion thereof adjacent said first flow directing means and the convex portion thereof being upstream of said concave portion in said operative position and a trailing edge portion orthogonal to said water surface and curved to constrain circulating water in said pool to flow along the downstream side of said arm means in said operative position.

35. The skimmer-diverter assembly according to claim 34, wherein said second flow diverting means is further responsive to release of said arm means from said retaining means and to the flow of water circulating in a said pool to constrain said arm portion to pivot in said mounting means and assume a wall adjacent position in said pool downstream of a said skimmer intake to effect a retracted position of said assembly.

36. The skimmer-diverter assembly according to claim 34, wherein said trailing edge portion includes an upstream surface portion and is formed as a continuous curved structure with said leading edge portion, terminating adjacent the said other end of said arm means; and said leading edge portion includes flow gate means defined therein for ingesting water flowing in a said pool and permitting said ingested water to engage said upstream surface portion of said trailing edge to constrain inward flow thereof along the downstream side of said arm means in said operative position.

37. The skimmer-diverter assembly of claim 36, wherein said second diverter means further comprises baffle means positioned adjacent the downstream side of the concave portion for preventing the accumulation of debris within said second diverting means and for directing current flow along the downstream side of said arm means in said operation position.

38. The skimmer-diverter assembly according to claim 36, wherein said second flow diverting means is further responsive to release of said arm means from said retaining means and to the flow of water circulating in a said pool to constrain said arm means to pivot in said mounting means and assume a wall adjacent position in said pool downstream of a said skimmer intake to effect a retracted position of said assembly.

39. The skimmer-diverter assembly according to claim 37, wherein said concave-convex leading edge includes a rear surface; and said rear surface of said leading edge, said upstream surface of said trailing edge and said flow gate means are responsive to the flow of water in a said pool to constrain said assembly to assume said retracted position upon release of said arm portion from said retaining means.

40. The skimmer-diverter assembly according to claim 36, wherein said first flow diverting means comprises an elongated upright surface portion substantially coextensive with said arm means and substantially orthogonal to the surface of said water and an elongated submerged surface portion substantially coextensive with and extending beneath said upright surface portion and having the lowermost edge thereof upstream of said upright surface portion in said operative position of said assembly.

41. The skimmer-diverter assembly according to claim 40, wherein said second flow diverting means is further responsive to release of said arm means from said retaining means and to the flow of water circulating in a said pool to constrain said arm means to pivot in said mounting means and assume a wall adjacent position in said pool downstream of a said skimmer intake to effect a retracted position of said assembly.

42. The skimmer-diverter assembly according to claim 40, wherein said second diverting means includes baffle means for directing water ingested through said flow gate means past said outer end and along the downstream side of said arm means in said operative position.

43. The skimmer-diverter assembly according to claim 42, wherein said second flow diverting means is further responsive to release of said arm portion from said retaining means and to the flow of water circulating in a said pool to constrain said arm portion to pivot in said mounting means and assume a wall adjacent position in said pool downstream of a said skimmer intake to effect a retracted position of said assembly.

44. The skimmer-diverter assembly according to claim 43 wherein said concave-convex leading edge includes a rear surface; and said rear surface of said leading edge, said upstream surface of said trailing edge and said flow gate means are responsive to the flow of water in a said pool to constrain said assembly to assume said retracted position upon release of said arm means from said retaining means.

45. The skimmer-diverter assembly of claim 15, wherein said arm means includes a ballast boom having a ballast chamber defined therein; vent means in said boom permitting ingress and egress of water to and from said ballast chamber; and valve means controlling the level of water in said chamber and the degree of flotation of said floating arm portion.

46. The skimmer-diverter assembly of claim 45, wherein said second flow diverting means is further responsive to release of said arm means from said retaining means and to the flow of water circulating in a said pool to constrain said arm means to pivot in said mounting means and assume a wall adjacent position in said pool downstream of a said skimmer intake to effect a retracted position of said assembly.

47. The skimmer diverter assembly of claim 45, wherein said first flow diverting means comprises an elongated upright surface portion substantially coextensive with said arm means and substantially orthogonal to the surface of said water and an elongated submerged surface portion substantially coextensive with and extending beneath said upright surface portion and having the lowermost edge thereof upstream of said upright surface portion in said operative position of said assembly.

* * * * *